US012241222B2

(12) United States Patent
Hatake et al.

(10) Patent No.: US 12,241,222 B2
(45) Date of Patent: Mar. 4, 2025

(54) WORK SYSTEM AND CONTROL METHOD

(71) Applicant: KOMATSU LTD., Tokyo (JP)

(72) Inventors: Kazuhiro Hatake, Tokyo (JP); Ryuta Okuwaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 191 days.

(21) Appl. No.: 17/999,610

(22) PCT Filed: May 14, 2021

(86) PCT No.: PCT/JP2021/018462
§ 371 (c)(1),
(2) Date: Nov. 22, 2022

(87) PCT Pub. No.: WO2021/241289
PCT Pub. Date: Dec. 2, 2021

(65) Prior Publication Data

US 2023/0193588 A1 Jun. 22, 2023

(30) Foreign Application Priority Data

May 29, 2020 (JP) ..... 2020-094389

(51) Int. Cl.
*E02F 3/43* (2006.01)

(52) U.S. Cl.
CPC ..... *E02F 3/439* (2013.01)

(58) Field of Classification Search
CPC ..... E02F 3/30; E02F 3/43; E02F 3/437; E02F 3/439; E02F 9/2033; B60Y 2200/412
USPC ..... 701/50
See application file for complete search history.

(56) References Cited

U.S. PATENT DOCUMENTS

| | | | | |
|---|---|---|---|---|
| 11,585,073 | B2 * | 2/2023 | Shike | E02F 9/2041 |
| 11,966,990 | B2 * | 4/2024 | Nakano | G01C 11/06 |
| 2016/0145827 | A1 | 5/2016 | Kami et al. | |
| 2017/0342678 | A1 * | 11/2017 | Iwamura | E02F 9/2033 |
| 2018/0266071 | A1 | 9/2018 | Matsuyama et al. | |

(Continued)

FOREIGN PATENT DOCUMENTS

| | | | |
|---|---|---|---|
| CN | 1651666 | A | 8/2005 |
| CN | 104619922 | A | 5/2015 |

(Continued)

OTHER PUBLICATIONS

Jin Zhengfu and Quan Long, "Analysis on dynamic characteristics of closed slewing system for large-scale hydraulic excavator," Proceedings of 2011 International Conference on Fluid Power and Mechatronics, Beijing, China, 2011, pp. 663-668, (https://ieeexplore.ieee.org/document/6045845) (Year: 2011).*

(Continued)

*Primary Examiner* — Atul Trivedi
(74) *Attorney, Agent, or Firm* — Global IP Counselors, LLP

(57) ABSTRACT

A stage specifying unit specifies a work stage of a work machine. A target decision unit decides target postures of a boom and an arm based on the specified work stage. A control amount calculation unit calculates a control amount of the boom and the arm based on the target postures. A limiting unit limits the control amount of the arm such that a change amount of the control amount of the arm is within a predetermined change amount when the specified work stage is a work stage related to a hoist swing.

7 Claims, 11 Drawing Sheets

(56) References Cited

U.S. PATENT DOCUMENTS

| | | | | |
|---|---|---|---|---|
| 2020/0024828 | A1* | 1/2020 | Asada | E02F 3/437 |
| 2020/0041331 | A1* | 2/2020 | Hoshino | E02F 9/2221 |
| 2020/0224383 | A1* | 7/2020 | Ishida | E02F 3/435 |
| 2020/0232191 | A1* | 7/2020 | Prior | E02F 9/264 |
| 2020/0340208 | A1* | 10/2020 | Kitajima | B66C 23/86 |
| 2020/0370278 | A1* | 11/2020 | Hita | E02F 9/262 |
| 2021/0071390 | A1* | 3/2021 | Kean | E02F 9/2029 |
| 2021/0071391 | A1* | 3/2021 | Takahashi | E02F 9/2296 |
| 2021/0079625 | A1* | 3/2021 | Narikawa | E02F 3/435 |
| 2021/0207340 | A1* | 7/2021 | Honda | E02F 3/32 |
| 2022/0010519 | A1* | 1/2022 | Izumikawa | E02F 9/2054 |
| 2022/0010522 | A1* | 1/2022 | Shiratani | E02F 9/2242 |
| 2022/0018096 | A1* | 1/2022 | Nishi | G06N 20/10 |
| 2022/0106764 | A1* | 4/2022 | Iwasaki | E02F 3/435 |
| 2022/0106773 | A1* | 4/2022 | Iwasaki | E02F 9/123 |
| 2022/0120059 | A1* | 4/2022 | Matsuyama | E02F 3/437 |
| 2022/0127825 | A1* | 4/2022 | Iwasaki | E02F 9/262 |
| 2022/0316173 | A1* | 10/2022 | Narikawa | E02F 9/2203 |
| 2022/0333338 | A1* | 10/2022 | Hayakawa | E02F 9/264 |
| 2022/0403617 | A1* | 12/2022 | Matsuyama | E02F 3/3677 |
| 2023/0033938 | A1* | 2/2023 | Matsuyama | E02F 9/265 |
| 2023/0313503 | A1* | 10/2023 | Hayakawa | E02F 9/2228 701/31.4 |
| 2023/0339734 | A1* | 10/2023 | Stahle | B60K 35/00 |
| 2023/0374757 | A1* | 11/2023 | Lee | E02F 9/26 |
| 2023/0392347 | A1* | 12/2023 | Nakamura | E02F 9/262 |
| 2024/0127372 | A1* | 4/2024 | Kawamoto | E02F 9/2054 |
| 2024/0209591 | A1* | 6/2024 | Honda | E02F 3/437 |

FOREIGN PATENT DOCUMENTS

| | | | | | |
|---|---|---|---|---|---|
| CN | 107109820 | A | | 8/2017 | |
| CN | 111788358 | A | * | 10/2020 | E02F 3/431 |
| CN | 111902585 | A | * | 11/2020 | E02F 3/435 |
| CN | 111954737 | A | * | 11/2020 | E02F 3/434 |
| EP | 3 779 067 | A1 | | 2/2021 | |
| EP | 3 882 400 | A1 | | 9/2021 | |
| EP | 4317616 | A1 | * | 2/2024 | E02F 9/205 |
| JP | 2002-115272 | A | | 4/2002 | |
| JP | 2017-166232 | A | | 9/2017 | |
| JP | 2018-154976 | A | | 10/2018 | |
| JP | 2020-56310 | A | | 4/2020 | |
| WO | 2019/189260 | A1 | | 10/2019 | |
| WO | WO-2020095945 | A1 | * | 5/2020 | E02F 3/32 |
| WO | WO-2020101004 | A1 | * | 5/2020 | E02F 3/32 |
| WO | WO-2020101005 | A1 | * | 5/2020 | E02F 3/32 |
| WO | WO-2020101006 | A1 | * | 5/2020 | E02F 3/32 |
| WO | WO-2020196674 | A1 | * | 10/2020 | E02F 3/43 |
| WO | WO-2020196877 | A1 | * | 10/2020 | E02F 3/43 |
| WO | WO-2020204007 | A1 | * | 10/2020 | E02F 3/435 |
| WO | WO-2020255970 | A1 | * | 12/2020 | E02F 3/32 |
| WO | WO-2023032970 | A1 | * | 3/2023 | E02F 3/435 |
| WO | WO-2023054603 | A1 | * | 4/2023 | |
| WO | WO-2023054608 | A1 | * | 4/2023 | E02F 3/40 |
| WO | WO-2023054610 | A1 | * | 4/2023 | E02F 3/3677 |
| WO | WO-2023054615 | A1 | * | 4/2023 | E02F 3/40 |
| WO | WO-2024053315 | A1 | * | 3/2024 | |

OTHER PUBLICATIONS

D. W. Hainsworth, et al., "Location of a dragline bucket in space using machine vision techniques," Proceedings of ICASSP '94. IEEE International Conference on Acoustics, Speech and Signal Processing, Adelaide, SA, Australia, 1994, pp. VI/161-VI/164 vol.6 (https://ieeexplore.ieee.org/document/389916) (Year: 1994).*

J. -C. Kim, S. Yoo, M. Kim, Y. -J. Kim and G. -H. Lee, "Safety Control of Automatic Excavator for Swing Collision Avoidance," 2018 15th International Conference on Ubiquitous Robots (UR), Honolulu, HI, USA, 2018, pp. 758-762, https://ieeexplore.ieee.org/document/8441774 (Year: 2018).*

Zhengfu, et al., "Analysis on dynamic characteristics of closed slewing system for large-scale hydraulic excavator," Proceedings of 2011 International Conference on Fluid Power and Mechatronics, Beijing, China, 2011, pp. 663-668 (https://ieeexplore.ieee.org/document/6045845) (Year: 2011).*

Hainsworth, et al., "Location of a dragline bucket in space using machine vision techniques," Proceedings of ICASSP '94. IEEE International Conference on Acoustics, Speech and Signal Processing, Adelaide, SA, Australia, 1994, pp. VI/161-VI/164 vol.6 (https://ieeexplore.ieee.org/document/389916) (Year: 1994).*

Kim, et al., "Safety Control of Automatic Excavator for Swing Collision Avoidance," 2018 15th International Conference on Ubiquitous Robots (UR), Honolulu, HI, USA, 2018, pp. 758-762 (https://ieeexplore.ieee.org/document/8441774) (Year: 2018).*

Du Hai Ruo, Introduction to Engineering Machinery, Southwest Jiaotong University Press, pp. 155-156. Aug. 31, 2006.

* cited by examiner

WORK SYSTEM AND CONTROL METHOD

CROSS-REFERENCE TO RELATED APPLICATIONS

This application is a U.S. National stage application of International Application No. PCT/JP2021/018462, filed on May 14, 2021. This U.S. National stage application claims priority under 35 U.S.C. § 119(a) to Japanese Patent Application No. 2020-094389, filed in Japan on May 29, 2020, the entire contents of which are hereby incorporated herein by reference.

The present disclosure relates to a work system and a control method. Priority is claimed to Japanese Patent Application No. 2020-094389, filed May 29, 2020, the content of which is incorporated herein by reference.

BACKGROUND INFORMATION

Japanese Unexamined Patent Application, First Publication No. 2002-115272 discloses a technique relating to an automatic operation of a hydraulic excavator. In the automatic operation of the hydraulic excavator, when earth held in a bucket spills during a swing operation, a work efficiency decreases. Japanese Unexamined Patent Application, First Publication No. 2002-115272 discloses a technique for dropping excess earth held in the bucket after the end of excavation and performing a swing operation in order to prevent the earth being spilled out.

SUMMARY

However, in view of work efficiency, it is preferable to load as much earth as possible in one swing loading operation. Therefore, it is required to perform a hoist swing without dropping earth as much as possible after excavation.

An object of the present disclosure is to provide a work system and a control method capable of suppressing dropping of the earth between excavation and dumping.

According to one aspect of the present disclosure, a work system that is a control device for a work machine including a boom, an arm, and a bucket, the work system includes: a stage specifying unit configured to specify a work stage of the work machine; a target decision unit configured to decide target postures of the boom and the arm based on the specified work stage; a control amount calculation unit configured to calculate a control amount of the boom and the arm based on the target postures; and a limiting unit configured to limit the control amount of the arm such that a change amount of the control amount of the arm is within a predetermined change amount in a case where the specified work stage is a work stage related to a hoist swing.

According to the above aspect, it is possible to suppress dropping of earth between excavation and dumping by the work machine.

DESCRIPTION OF EMBODIMENTS

First Embodiment

<<Work System 1>>

Figure 1:
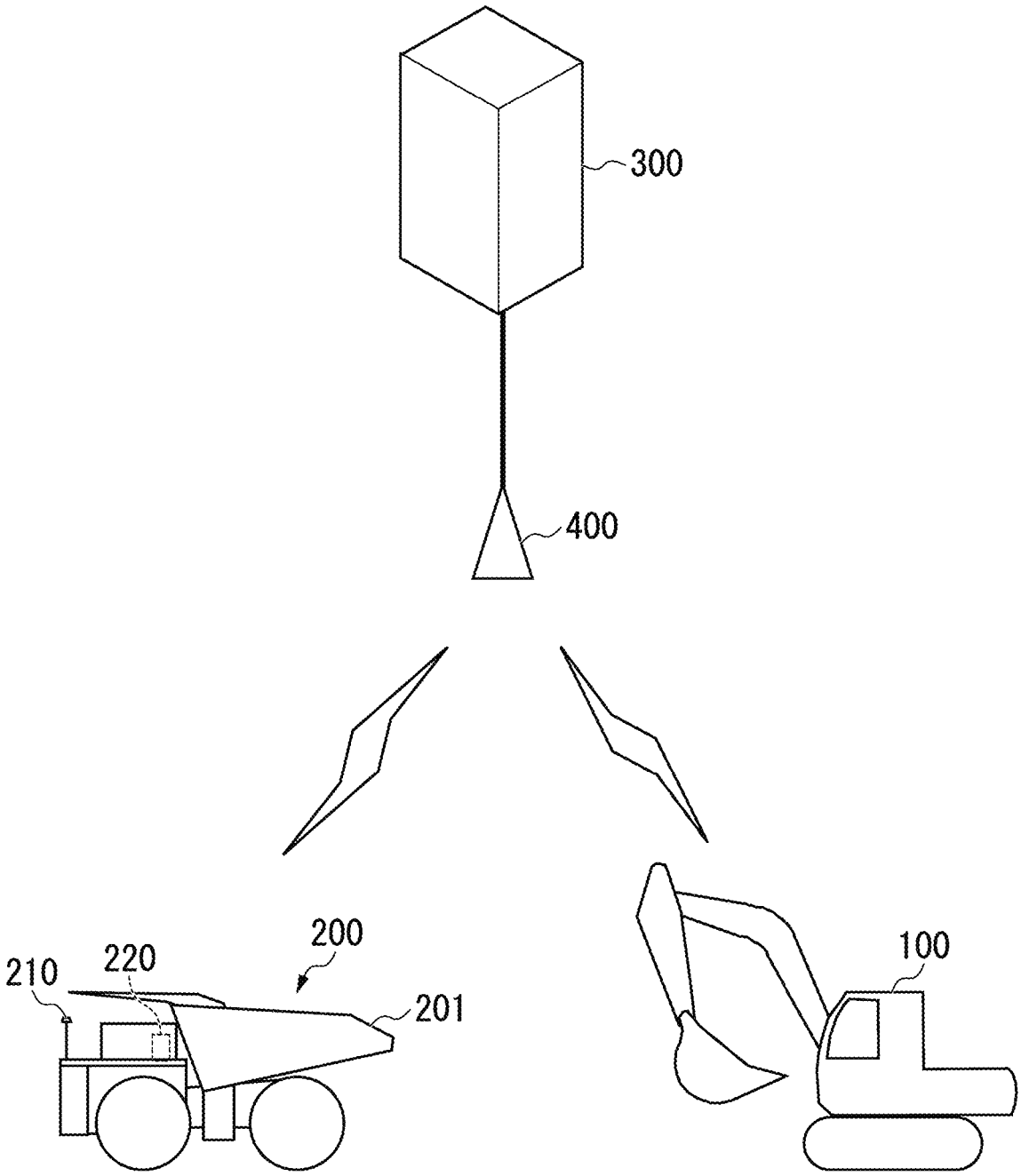
FIG. 1 is a schematic diagram showing a configuration of a work system according to a first embodiment.

FIG. 1 is a schematic diagram showing a configuration of a work system according to a first embodiment.

A work system 1 includes a work machine 100, one or a plurality of transport vehicles 200, and a controlling device 300. The work system 1 is an unmanned transport system that automatically controls the work machine 100 and the transport vehicle 200 by the controlling device 300.

The transport vehicle 200 travels in an unmanned manner, based on course data (for example, speed data, and coordinates to which the transport vehicle 200 should travel) that is received from the controlling device 300. The transport vehicle 200 and the controlling device 300 are connected to each other by communication via an access point 400. The controlling device 300 acquires a position and an azimuth direction from the transport vehicle 200, and generates course data that is used for the traveling of the transport vehicle 200, based on the position and the azimuth direction. The controlling device 300 transmits the course data to the transport vehicle 200. The transport vehicle 200 travels in an unmanned manner, based on the received course data. The work system 1 according to the first embodiment includes an unmanned transport system. However, in another embodiment, some or all of the transport vehicles 200 may be operated in a manned manner. In this case, the controlling device 300 does not need to perform transmission of the course data and an instruction regarding loading. However, the controlling device 300 acquires the position and the azimuth direction of the transport vehicle 200.

The work machine 100 is controlled in an unmanned manner according to an instruction that is received from the controlling device 300. The work machine 100 and the controlling device 300 are connected to each other by communication via the access point 400.

The work machine 100 and the transport vehicle 200 are provided at a work site (for example, a mine or a quarry). On the other hand, the controlling device 300 may be provided at any place. For example, the controlling device 300 may be provided at a point (for example, in a city or a work site) away from the work machine 100 and the transport vehicle 200.

<<Transport Vehicle 200>>

The transport vehicle 200 according to the first embodiment is a dump truck provided with a dump body 201 (i.e., loading container). The transport vehicle 200 according to another embodiment may be a transport vehicle other than a dump truck.

The transport vehicle 200 includes the dump body 201, a position and azimuth direction calculator 210, and a control device 220. The position and azimuth direction calculator 210 calculates the position and azimuth direction of the transport vehicle 200. The position and azimuth direction calculator 210 includes two receivers that receive positioning signals from artificial satellites configuring a global navigation satellite system (i.e., GNSS). An exemplary example of the GNSS is a global positioning system (i.e., GPS). The two receivers are installed at different positions on the transport vehicle 200. The position and azimuth direction calculator 210 detects the position of the transport vehicle 200 in a field coordinate system, based on the positioning signals received by the receivers. The position and azimuth direction calculator 210 uses each positioning signal received by the two receivers to calculate the azimuth direction in which the transport vehicle 200 faces, as the relationship between the installation position of the receiver on one side and the installation position of the receiver on the other side. In another embodiment, the configuration is not limited thereto. For example, the transport vehicle 200 may include an inertial measurement unit (i.e., IMU), and may calculate the azimuth direction, based on a measurement result of the inertial measurement unit. In this case, a drift of the inertial measurement unit may be corrected based on a traveling trajectory of the transport vehicle 200.

The control device 220 transmits the detected position and azimuth direction by the position and azimuth direction calculator 210 to the controlling device 300. The control device 220 receives, from the controlling device 300, the course data, a dumping instruction, an entry instruction to a loading point P3, and a departure instruction from the loading point P3. The control device 220 causes the transport vehicle 200 to travel according to the received course data, or raises and lowers the dump body 201 of the transport vehicle 200 according to the dumping instruction. When the transport vehicle arrives and stops at a destination, based on the instruction, the control device 220 transmits a notification of the arrival at the destination to the controlling device 300.

<<Work Machine 100>>

Figure 2:
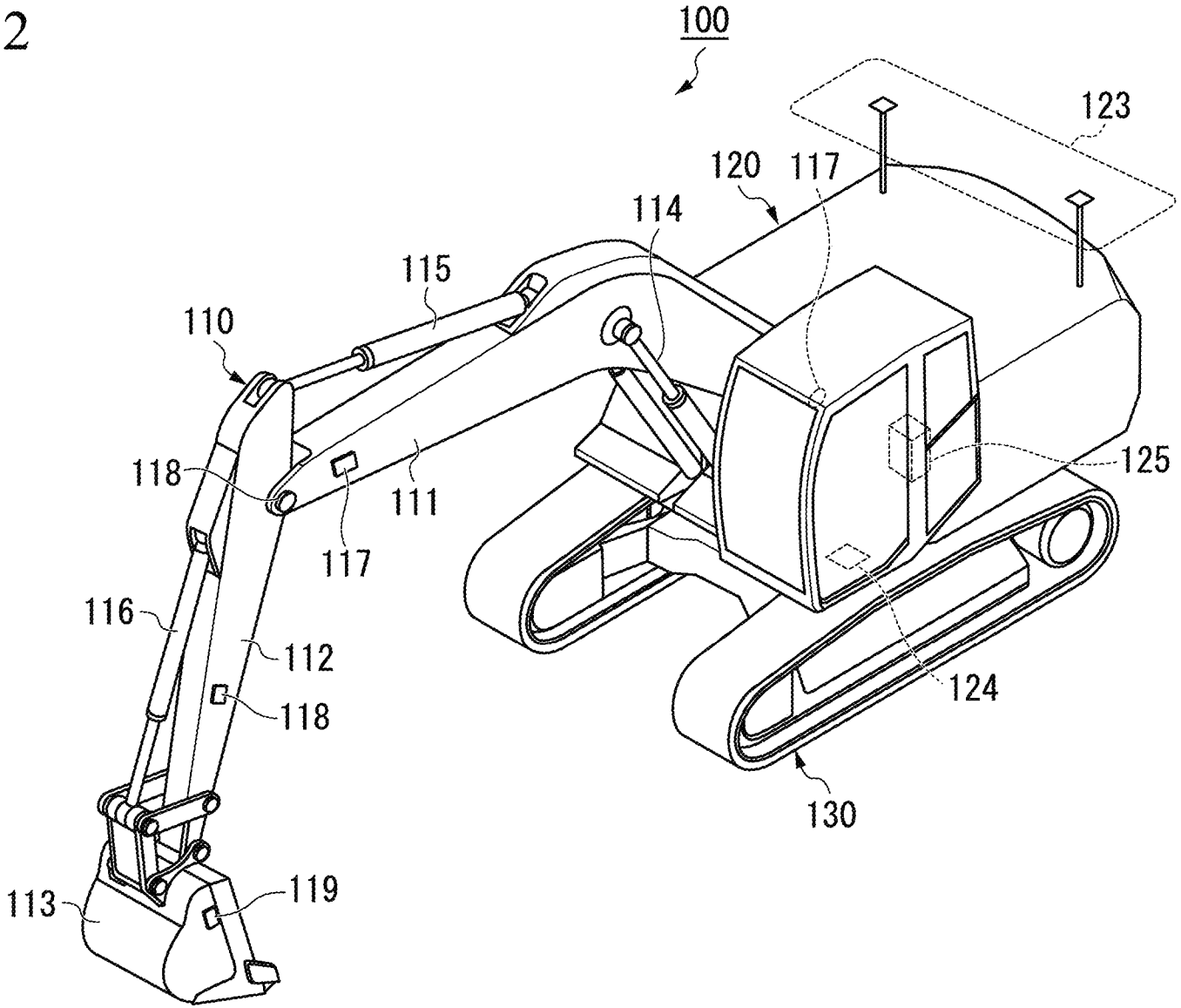
FIG. 2 is an external view of the work machine according to the first embodiment.

FIG. 2 is an external view of the work machine 100 according to the first embodiment.

The work machine 100 according to the first embodiment is a hydraulic excavator. The work machine 100 according to another embodiment may be a work vehicle other than a hydraulic excavator.

The work machine 100 includes a work equipment 110 that is hydraulically operated, a swing body 120 that supports the work equipment 110, and an undercarriage 130 that supports the swing body 120.

The work equipment 110 includes a boom 111, an arm 112, a bucket 113, a boom cylinder 114, an arm cylinder 115, a bucket cylinder 116, a boom angle sensor 117, an arm angle sensor 118, and a bucket angle sensor 119.

A base end portion of the boom 111 is mounted to a front portion of the swing body 120 through a pin.

The arm 112 connects the boom 111 and the bucket 113. A base end portion of the arm 112 is mounted to a tip portion of the boom 111 through a pin.

The bucket 113 includes a blade for excavating an excavated material such as earth, and a container for transporting the excavated material. A base end portion of the bucket 113 is mounted to a tip portion of the arm 112 through a pin.

The boom cylinder 114 is a hydraulic cylinder for operating the boom 111. A base end portion of the boom cylinder 114 is mounted to the swing body 120. A tip portion of the boom cylinder 114 is mounted to the boom 111.

The arm cylinder 115 is a hydraulic cylinder for driving the arm 112. A base end portion of the arm cylinder 115 is mounted to the boom 111. A tip portion of the arm cylinder 115 is mounted to the arm 112.

The bucket cylinder 116 is a hydraulic cylinder for driving the bucket 113. A base end portion of the bucket cylinder 116 is mounted to the arm 112. The tip portion of the bucket cylinder 116 is mounted to a bucket link mechanism and operates the bucket 113 through the bucket link mechanism.

The boom angle sensor 117 is mounted to the boom 111 and detects an inclination angle of the boom 111.

The arm angle sensor 118 is mounted to the arm 112 and detects an inclination angle of the arm 112.

The bucket angle sensor 119 is mounted to the bucket 113 and detects an inclination angle of the bucket 113.

The boom angle sensor 117, the arm angle sensor 118, and the bucket angle sensor 119 according to the first embodiment detect an inclination angle with respect to a horizon plane. An angle sensor according to another embodiment is not limited to this, and may detect an inclination angle with respect to another reference plane. For example, in another embodiment, the angle sensor may detect a relative angle with a mounting portion as a reference, or may detect an inclination angle by measuring a stroke of each cylinder and converting the stroke of the cylinder into an angle. The inclination angles and the stroke amount (i.e., cylinder length) of the boom 111, the arm 112, and the bucket 113 represent the postures of the boom 111, the arm 112, and the bucket 113.

The work machine 100 includes a position and azimuth direction calculator 123, an inclination measuring instrument 124, and a control device 125.

The position and azimuth direction calculator 123 calculates the position of the swing body 120 and the azimuth direction in which the swing body 120 faces. The position and azimuth direction calculator 123 includes two receivers that receive positioning signals from artificial satellites configuring the GNSS. The two receivers are installed at different positions on the swing body 120. The position and azimuth direction calculator 123 detects the position of a representative point of the swing body 120 (i.e., the swing center of the swing body 120) in the field coordinate system, based on the positioning signal received by the receiver on one side.

The position and azimuth direction calculator 123 calculates the azimuth direction in which the swing body 120 faces, as the relationship between the installation position of the receiver on one side and the installation position of the receiver on the other side, by using each of the positioning signals received by the two receivers.

The inclination measuring instrument 124 measures an acceleration and angular velocity of the swing body 120, and detects a posture (for example, a roll angle, a pitch angle, or a yaw angle) of the swing body 120, based on the measurement result. The inclination measuring instrument 124 is installed, for example, on a lower surface of the swing body 120. As the inclination measuring instrument 124, for example, an inertial measurement unit (i.e., IMU) can be used.

The control device 125 transmits a swing speed, position, and azimuth direction of the swing body 120, the inclination angles of the boom 111, the arm 112, and the bucket 113, the traveling speed of the undercarriage 130, and the posture of the swing body 120 to the controlling device 300. Hereinafter, the data collected from various sensors by the work machine 100 or the transport vehicle 200 is also referred to as vehicle data. Vehicle data according to another embodiment is not limited to this. For example, the vehicle data according to another embodiment may not include any of the swing speed, the position, the azimuth direction, the inclination angle, the traveling speed, and the posture, or may include values detected by other sensors and may include a value calculated from the detected value. The control device 125 can convert the position of the field coordinate system and the position of a machine coordinate system to each other by using the position of the representative point of the swing body 120 in the field coordinate system, which is detected by the position and azimuth direction calculator 123, and the azimuth direction and the posture of the swing body 120 according to the vehicle data.

The control device 125 receives a control instruction from the controlling device 300. The control device 125 drives the work equipment 110, the swing body 120, or the undercarriage 130 according to the received control instruction. When the driving based on the control instruction is completed, the control device 125 transmits a notification of the completion to the controlling device 300. The detailed configuration of the control device 125 will be described later.

<<Controlling Device 300>>

Figure 3:
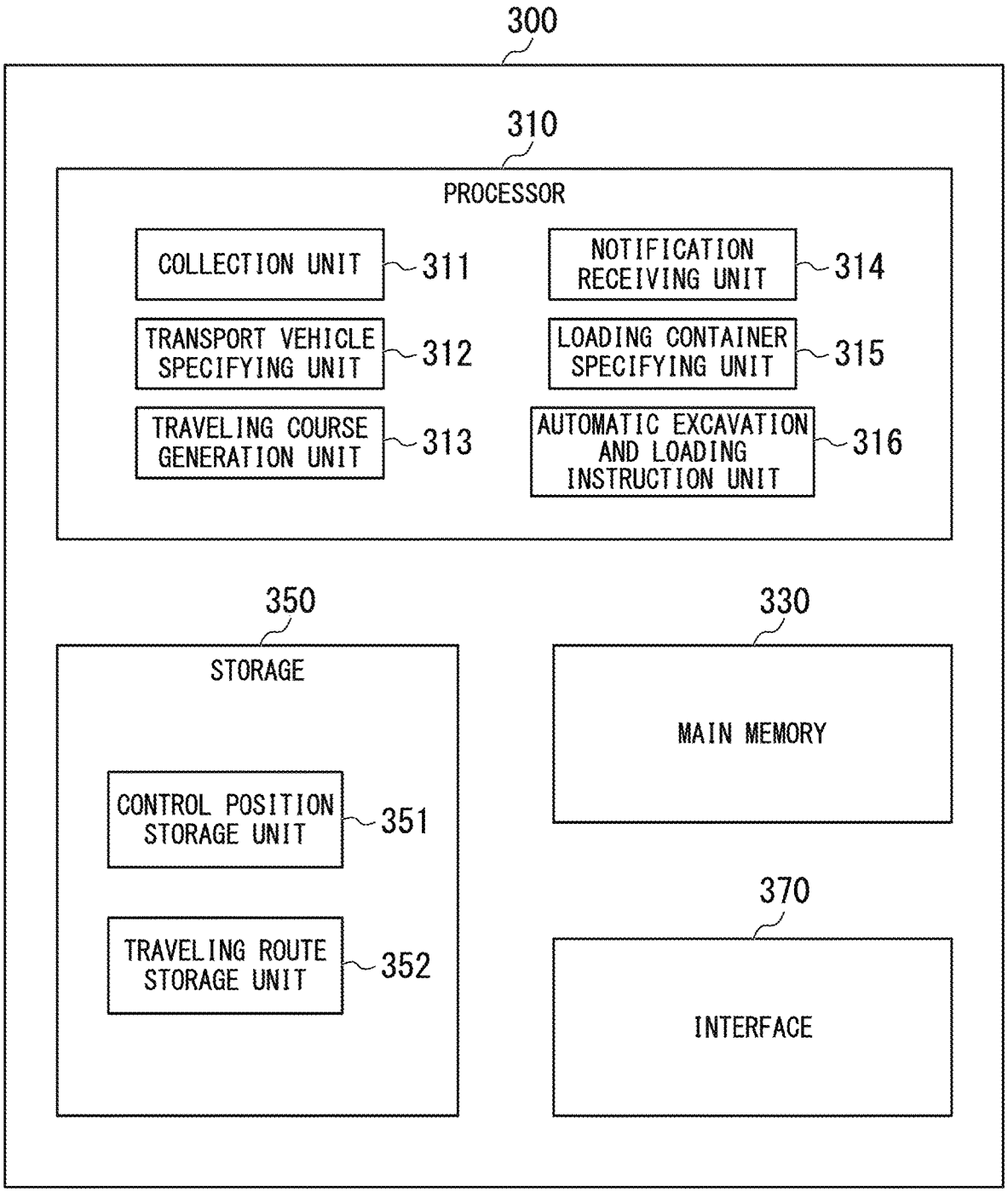
FIG. 3 is a schematic block diagram showing a configuration of a controlling device according to the first embodiment.

FIG. 3 is a schematic block diagram showing the configuration of the controlling device 300 according to the first embodiment. The controlling device 300 manages the operation of the work machine 100 and the traveling of the transport vehicle 200. The controlling device 300 is a computer that includes a processor 310, a main memory 330, a storage 350, and an interface 370. The storage 350 stores a program. The processor 310 reads out the program from the storage 350, expands it into the main memory 330, and executes processing according to the program. The controlling device 300 is connected to a network through the interface 370. As an example of the processor 310, a central processing unit (i.e., CPU), a graphic processing unit (i.e., GPU), a microprocessor, or the like can be given.

The program may be a program for realizing some of the functions that are exerted by the computer of the controlling device 300. For example, the program may be a program that exerts the functions in combination with another program already stored in the storage 350 or in combination with another program mounted on another device. In another embodiment, the controlling device 300 may be provided with a custom large scale integrated circuit (i.e., LSI) such as a programmable logic device (i.e., PLD) in addition to or instead of the above configuration. As an example of the PLD, a programmable array logic (i.e., PAL), a generic array logic (i.e., GAL), a complex programmable logic device (i.e., CPLD), or a field programmable gate array (i.e., FPGA) can be given. In this case, some or all of the functions that are realized by the processor 310 may be realized by a relevant integrated circuit. Such an integrated circuit is also included as an example of the processor.

The storage 350 has storage areas as a control position storage unit 351 and a traveling route storage unit 352. As an example of the storage 350, a magnetic disk, a magneto-optical disk, an optical disk, a semiconductor memory, or the like can be given. The storage 350 may be an internal medium directly connected to a common communication line of the controlling device 300, or an external medium that is connected to the controlling device 300 through the interface 370. The storage 350 is a non-transitory tangible storage medium.

The control position storage unit 351 stores position data of an excavation point P22 and the loading point P3. The excavation point P22 and the loading point P3 are points that are set in advance by, for example, an operation by a manager or the like at the work site.

Figure 4:
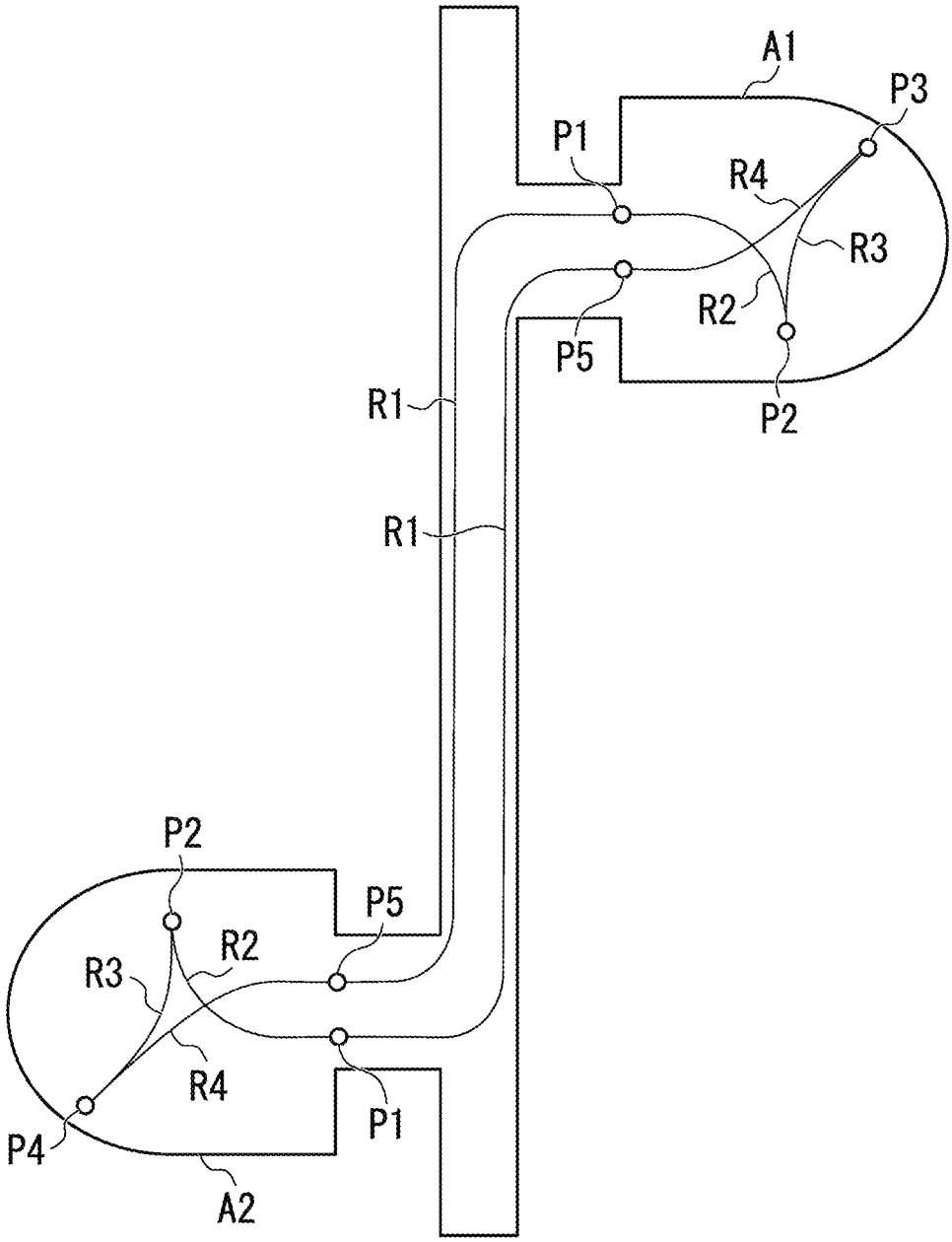
FIG. 4 is a diagram showing an example of a traveling route.

FIG. 4 is a diagram showing an example of a traveling route R.

The traveling route storage unit 352 stores a traveling route R for each transport vehicle 200. The traveling route R includes a connection route R1 that connects two areas A (for example, a loading field A1 and a dumping field A2) and is determined in advance, and an entry route R2, an approach route R3, and an exit route R4 that are routes in the area A. The entry route R2 is a route that connects a standby point P1 which is one end of the connection route R1 and a predetermined turning point P2 in the area A. The approach route R3 is a route that connects the turning point P2 and the loading point P3 or a dumping point P4 in the area A. The exit route R4 is a route that connects the loading point P3 or the dumping point P4 and an exit point P5 which is the other end of the connection route R1 in the area A. The turning point P2 is a point that is set by the controlling device 300 according to the position of the loading point P3. The controlling device 300 calculates the entry route R2, the approach route R3, and the exit route R4 each time the loading point P3 is changed.

The processor 310 is provided with a collection unit 311, a transport vehicle specifying unit 312, a traveling course generation unit 313, a notification receiving unit 314, a loading container specifying unit 315, and an automatic excavation and loading instruction unit 316 by the execution of the program.

The collection unit 311 receives vehicle data from the work machine 100 and the transport vehicle 200 through the access point 400.

The transport vehicle specifying unit 312 specifies the transport vehicle 200 to be loaded with the excavated material, based on the vehicle data of the transport vehicle 200 collected by the collection unit 311.

The traveling course generation unit 313 generates course data indicating an area in which the movement of the transport vehicle 200 is permitted, based on the traveling route R stored in the traveling route storage unit 352 and the vehicle data collected by the collection unit 311, and transmits the course data to the transport vehicle 200. The course data is, for example, data representing an area in which the transport vehicle 200 can travel at a predetermined speed within a certain time and which does not overlap the traveling route R of another transport vehicle 200.

The notification receiving unit 314 receives a notification of the completion from the work machine 100, and receives a notification of the arrival from the transport vehicle 200.

In a case of receiving the notification of the arrival at the loading point P3 from the transport vehicle 200, the loading container specifying unit 315 specifies the position of the dump body 201 in the field coordinate system, based on the vehicle data of the transport vehicle 200. For example, the loading container specifying unit 315 specifies the position of the dump body 201 in the field coordinate system by disposing three-dimensional data representing an outer shape of the dump body 201 at the position that is indicated by the position data of the transport vehicle 200 and rotating the three-dimensional data in a direction that is indicated by the azimuth direction data of the transport vehicle 200. The loading container specifying unit 315 transmits the specified position of the dump body 201 to the work machine 100.

The automatic excavation and loading instruction unit 316 transmits an automatic excavation and loading instruction that includes the position of the excavation point P22 and the position of the loading point P3 stored in the control position storage unit 351 to the work machine 100.

<<Control Device 125 of Work Machine 100>>

Figure 5:
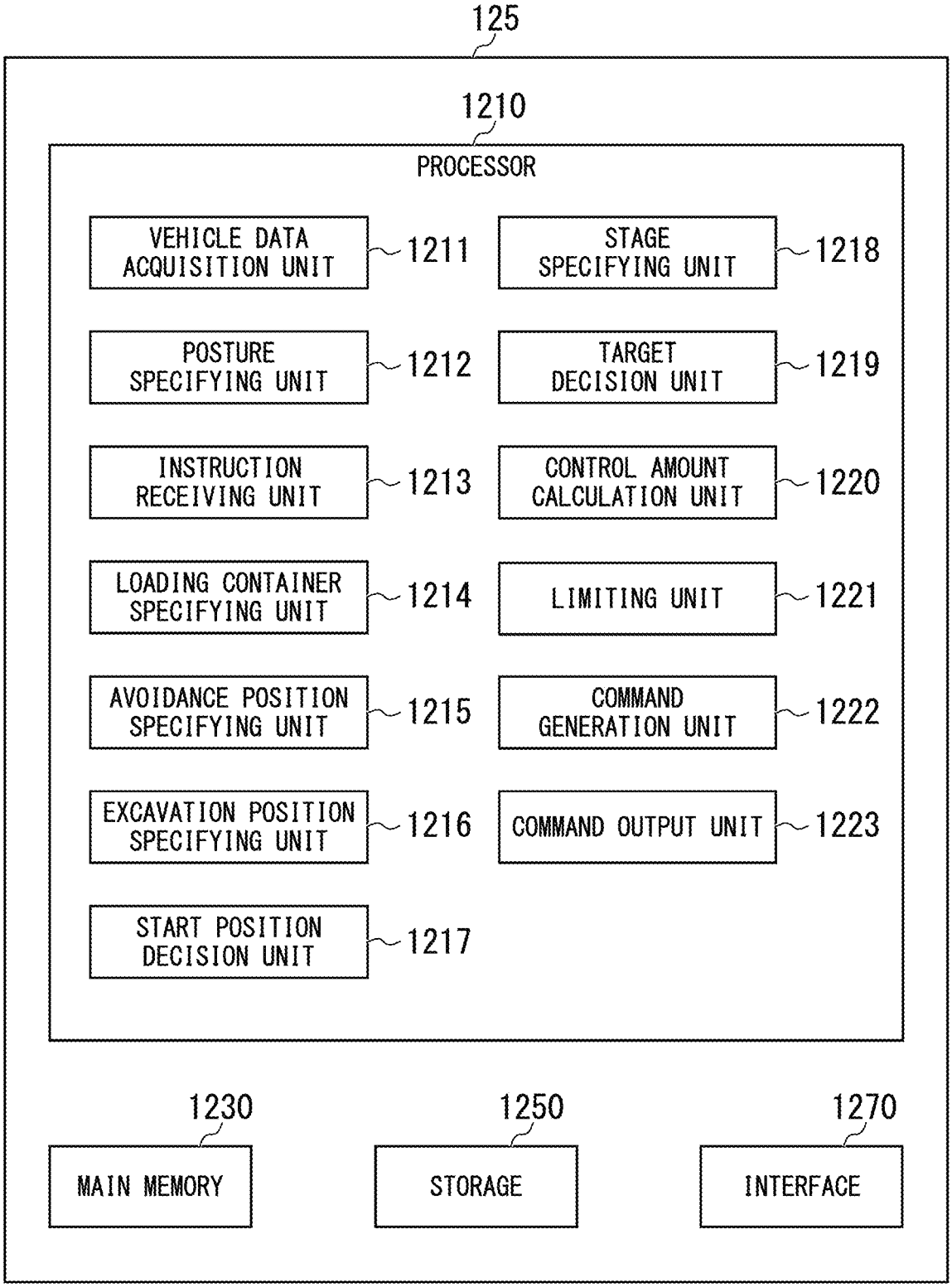
FIG. 5 is a schematic block diagram showing a configuration of the control device of the work machine according to the first embodiment.

FIG. 5 is a schematic block diagram showing the configuration of the control device 125 of the work machine 100 according to the first embodiment.

The control device 125 controls an actuator of the work machine 100, based on the instruction of the controlling device 300.

The control device 125 is a computer that includes a processor 1210, a main memory 1230, a storage 1250, and an interface 1270. The storage 1250 stores a program. The processor 1210 reads out the program from the storage 1250, expands it in the main memory 1230, and executes processing according to the program. The control device 125 is connected to the network through the interface 1270. As an example of the processor 1210, a central processing unit (i.e., CPU), a graphic processing unit (i.e., GPU), a microprocessor, or the like can be given.

The program may be a program for realizing some of the functions that are exerted by the computer of the control device 125. For example, the program may be a program that exerts the functions in combination with another program already stored in the storage 1250 or in combination with another program mounted on another device. In another embodiment, the control device 125 may be provided with a custom LSI such as a PLD in addition to or instead of the above configuration. In this case, some or all of the functions that are realized by the processor 1210 may be realized by a relevant integrated circuit. Such an integrated circuit is also included as an example of the processor.

As an example of the storage 1250, a magnetic disk, a magneto-optical disk, an optical disk, a semiconductor memory, or the like can be given. The storage 1250 may be an internal medium directly connected to a common communication line of the control device 125, or an external medium that is connected to the control device 125 through the interface 1270. The storage 1250 is a non-transitory tangible storage medium.

The processor 1210 is provided with a vehicle data acquisition unit 1211, a posture specifying unit 1212, an instruction receiving unit 1213, a loading container specifying unit 1214, an avoidance position specifying unit 1215, an excavation position specifying unit 1216, a start position decision unit 1217, a stage specifying unit 1218, a target decision unit 1219, a control amount calculation unit 1220, a limiting unit 1221, a command generation unit 1222, and a command output unit 1223 by the execution of the program.

The vehicle data acquisition unit 1211 acquires vehicle data from various sensors included in the work machine 100, and transmits the acquired vehicle data to the controlling device 300.

The posture specifying unit 1212 specifies the position of the bucket 113 in the machine coordinate system with the work machine 100 as a reference, based on the vehicle data acquired by the vehicle data acquisition unit 1211. The posture specifying unit 1212 specifies the positions of a plurality of points on the contour of the bucket 113 including the teeth and the bottom portion.

Specifically, the posture specifying unit 1212 specifies the positions of the boom 111, the arm 112, and the bucket 113 by the following procedure. The posture specifying unit 1212 specifies a pitch angle of the swing body 120 acquired by the vehicle data acquisition unit 1211. The posture specifying unit 1212 obtains an absolute angle of the boom 111, based on the inclination angle of the boom 111 and the pitch angle of the swing body 120. The inclination angle is an angle with respect to the horizon plane, and the absolute angle is an angle with the machine coordinate system as a reference. The posture specifying unit 1212 obtains the position of the tip portion of the boom 111, based on the absolute angle of the boom 111 and the known length (i.e., the distance from the pin at the base end portion to the pin at the tip portion) of the boom 111. The posture specifying unit 1212 obtains the absolute angle of the arm 112, based on the pitch angle of the swing body 120 and the inclination angle of the arm 112. The posture specifying unit 1212 obtains the position of the tip portion of the arm 112, based on the position of the tip portion of the boom 111, the absolute angle of the arm 112, and the known length (i.e., the distance from the pin at the base end portion to the pin at the tip portion) of the arm 112.

The posture specifying unit 1212 obtains the absolute angle of the bucket 113, based on the pitch angle of the swing body 120 and the inclination angle of the bucket 113. The posture specifying unit 1212 obtains the positions of the plurality of points on the contour of the bucket 113, based on the position of the tip portion of the arm 112, the absolute angle of the bucket 113, and the distances from the pin of the bucket 113 to the plurality of points on the contour of the bucket 113.

The instruction receiving unit 1213 receives an automatic excavation and loading instruction from the controlling device 300. The instruction receiving unit 1213 determines that the automatic excavation and loading control is started, with the reception of the automatic excavation and loading instruction. The automatic excavation and loading control includes automatic dumping control. That is, the instruction receiving unit 1213 is an example of the automatic control determination unit that determines whether or not to start the automatic dumping control.

The loading container specifying unit 1214 receives the position of the dump body 201 of the transport vehicle 200 from the controlling device 300, and converts the position of the dump body 201 from the field coordinate system to the machine coordinate system, based on the vehicle data acquired by the vehicle data acquisition unit 1211.

Figure 6:
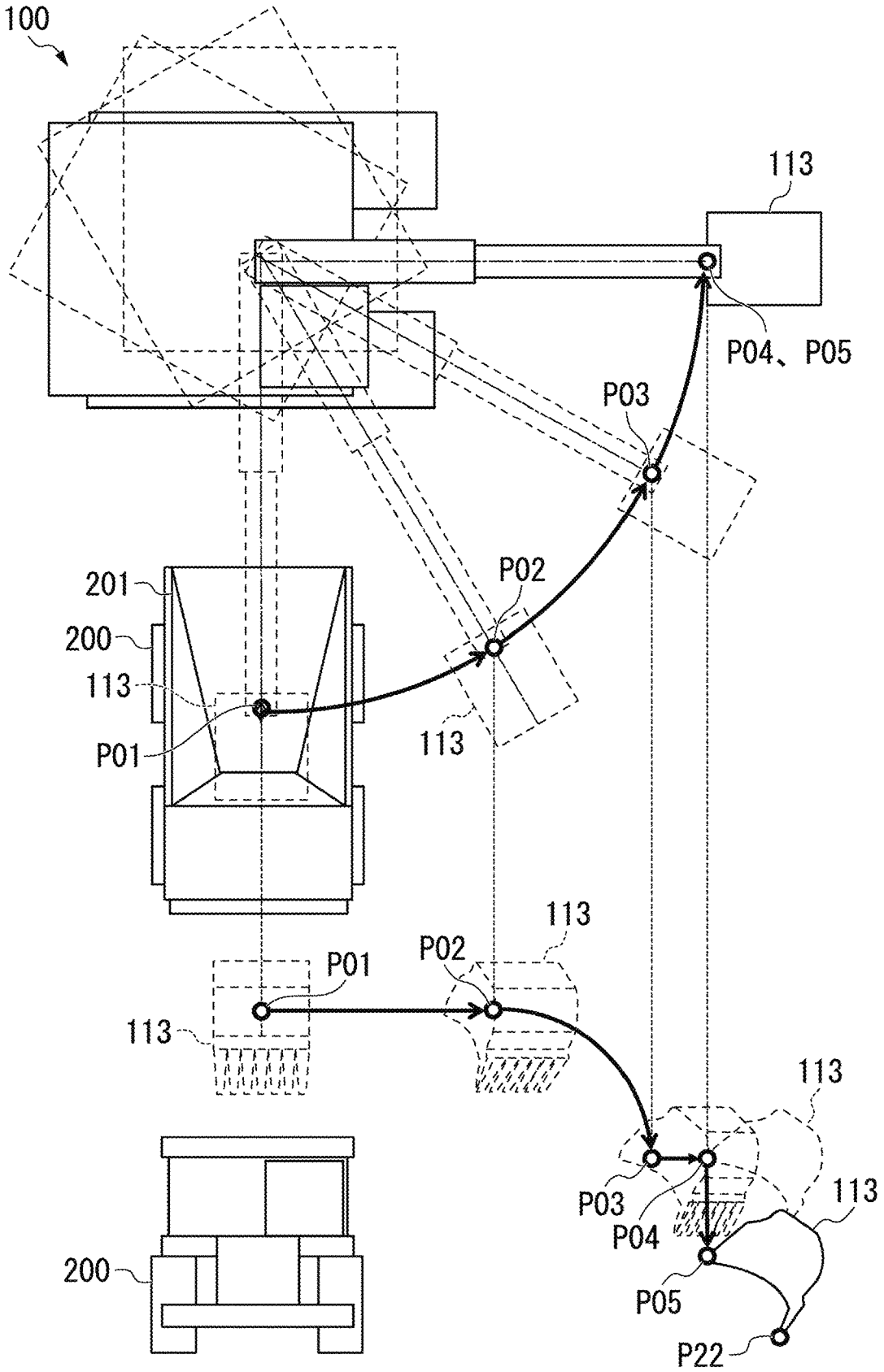
FIG. 6 is a diagram showing an example of a route of a bucket before excavation in automatic excavation and loading control according to the first embodiment.

FIG. 6 is a diagram showing an example of the route of the bucket 113 before the excavation in the automatic excavation and loading control according to the first embodiment.

The avoidance position specifying unit 1215 specifies an interference avoidance position P02 which is a point where the work equipment 110 and the transport vehicle 200 do not interfere with each other when viewed in a plan view from above, based on the position of the work machine 100, the position of the dump body 201, and the position (i.e., a load-empty swing start position P01) of the pin of the bucket 113 at the time of control start. The interference avoidance position P02 is a position which has the same height as the load-empty swing start position P01, and in which the distance from the swing center of the swing body 120 is equal to the distance from the swing center to the load-empty swing start position P01 and the transport vehicle 200 does not exist below. The avoidance position specifying unit 1215 specifies, for example, a circle centered on the swing center of the swing body 120 and having a radius that is defined by the distance between the swing center and the load-empty swing start position P01, and specifies, as the interference avoidance position P02, a position where the outer shape of the bucket 113 does not interfere with the transport vehicle 200 when viewed in a plan view from above and which is closest to the load-empty swing start position P01, among the positions on the circle. The avoidance position specifying unit 1215 can determine whether or not the transport vehicle 200 and the bucket 113 interfere with each other, based on the position of the transport vehicle 200 and the positions of the plurality of points on the contour of the bucket 113. Here, the expressions "same height" and "equal distance" are not necessarily limited to an exactly same height or distance, and some errors or margins are allowed.

The excavation position specifying unit 1216 specifies, as an excavation position P05, a point P2 separated from the excavation point P22 included in the automatic excavation and loading instruction by the distance from the pin to the teeth of the bucket 113. That is, in a case where the bucket 113 is in a predetermined excavation posture with the teeth facing in a dump direction, when the teeth of the bucket 113 is located at the excavation point P22, the pin of the bucket 113 is located at the excavation position P05.

Further, the excavation position specifying unit 1216 decides the position above the excavation position P05 by a predetermined height, as a swing end position P04.

Figure 7:
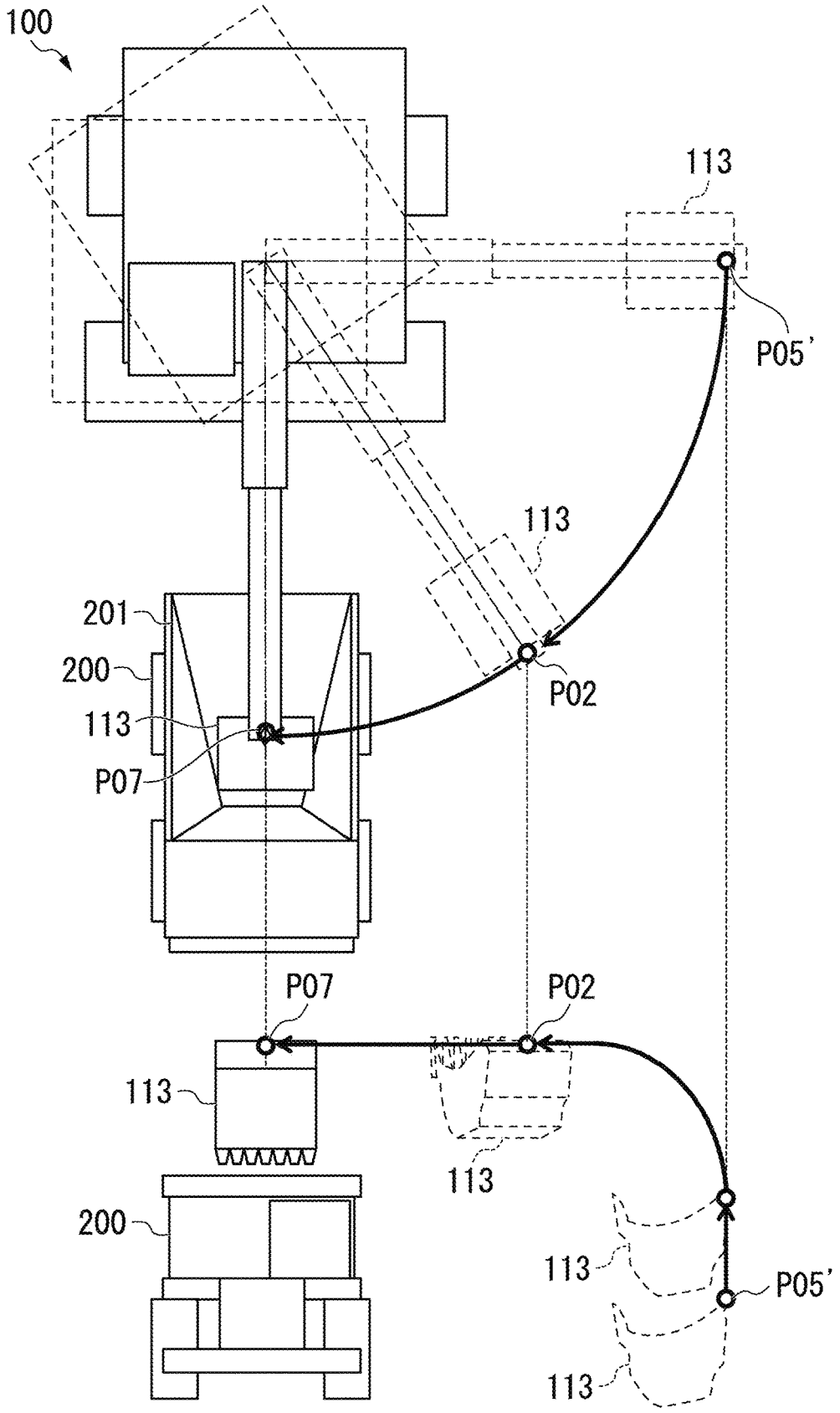
FIG. 7 is a diagram showing an example of a route of the bucket after excavation in the automatic excavation and loading control according to the first embodiment.

FIG. 7 is a diagram showing an example of the route of the bucket 113 after the excavation in the automatic excavation and loading control according to the first embodiment.

The start position decision unit 1217 decides the dumping start position P07, based on the position of the dump body 201. Specifically, the start position decision unit 1217 decides the height of the dumping start position P07 to be a height obtained by adding the height of the bucket 113 and the height of the control margin of the bucket 113 to the height of the dump body 201.

The stage specifying unit 1218 specifies the work stages of the work machine 100, based on the vehicle data acquired by the vehicle data acquisition unit 1211. The work stages include a down swing stage, an excavation stage, a hoist swing stage, and a dump stage. The hoist swing is a work of swing the swing body 120 while raising the boom 111 to move the bucket 113 above the dump body 201. The down swing is a work of swing the swing body 120 while lowering the boom 111 to move the bucket 113 to the excavation position. The method of specifying the work stage by the stage specifying unit 1218 will be described later.

The target decision unit 1219 decides target inclination angles of the boom 111, the arm 112, and the bucket 113 according to the work stage of the work machine 100. Each target inclination angle is represented as an angle with respect to the horizon plane. Specifically, the target decision unit 1219 decides the target inclination angles of the boom 111 and the arm 112 such that the position of the tip of the arm 112 becomes the excavation position P05 in the down swing stage. Further, the target decision unit 1219 decides the target inclination angle of the bucket 113 such that the angle of the bucket 113 becomes a predetermined angle suitable for the next excavation in the down swing stage. In the excavation stage, the target decision unit 1219 calculates a target route of the teeth of the bucket 113 sequentially so that the bucket 113 can excavate a predetermined amount of earth, and decides the target inclination angles of the boom 111, the arm 112, and the bucket 113, based on the target route. In the hoist swing stage, the target decision unit 1219 decides the target inclination angles of the boom 111 and the arm 112 such that the position of the tip of the arm 112 becomes the dumping start position P07. In the dump stage, the target decision unit 1219 decides the target inclination angle of the bucket 113 to a predetermined dump completion angle. The target inclination angle is an example of the target posture.

The control amount calculation unit 1220 calculates the control amount of the boom 111, the arm 112, and the bucket 113, based on the vehicle data acquired by the vehicle data acquisition unit 1211 and the target inclination angle decided by the target decision unit 1219. Specifically, the control amount calculation unit 1220 decides the control amount of the boom 111, the arm 112, and the bucket 113 by inputting a difference between the measured values of the inclination angles of the boom 111, the arm 112, and the bucket 113 and the target inclination angle into a predetermined function. In the function, the difference between the measured values of the inclination angles and the target inclination angles and the control amount have a monotonous increase relationship. "Monotonically increase" means that when one value increases, the other value always increases or does not change (i.e., monotonic non-decrease). In a case where the work stage is the hoist swing stage, the command generation unit 1222 decides the control amount of the bucket 113 such that a ground angle of the bucket 113 does not change even the boom 111 and the arm 112 are driven.

In a case where the work stage specified by the stage specifying unit 1218 is the hoist swing stage, the limiting unit 1221 limits the control amount of the arm 112 calculated by the control amount calculation unit 1220 so that the change amount is within a predetermined change amount upper limit value. The detailed behavior of the limiting unit 1221 will be described later.

In a case where the instruction receiving unit 1213 receives the excavation and loading instruction, the command generation unit 1222 generates the swing command, the boom command, the arm command, and the bucket command based on the control amount of the work equipment 110 that is calculated by the control amount calculation unit 1220 or limited by the limiting unit 1221. Further, in a case where the work stage is the down swing stage, the command generation unit 1222 temporarily stops the boom 111 and the arm 112 when the height of the pin of the bucket 113 is the same height as the swing end position P04, and further drives the boom 111 and the arm 112 after the tip of the arm 112 arrives the swing end position P04. In a case where the work stage is the excavation stage, the command generation unit 1222 generates an arm command for rotating the arm 112 in a pulling direction in addition to a bucket command for rotating the bucket 113 in an excavation direction.

The command output unit 1223 outputs the swing command, the boom command, the arm command, and the bucket command.

Figure 8:
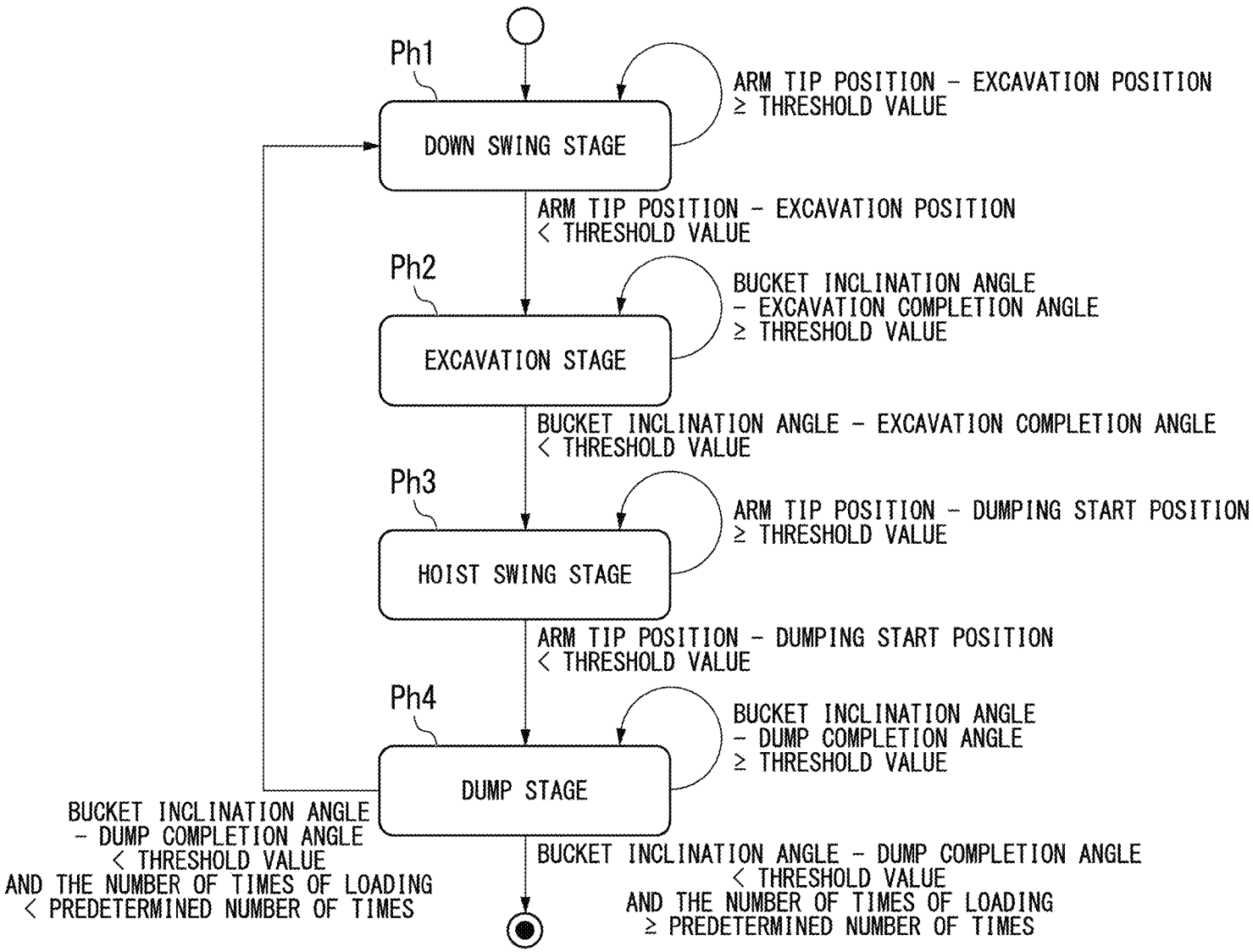
FIG. 8 is a state transition diagram showing a transition of a work stage according to the first embodiment.

FIG. 8 is a state transition diagram showing a transition of the work stage according to the first embodiment.

When the instruction receiving unit 1213 receives the input of the automatic excavation and loading instruction from the controlling device 300 and the automatic excavation and loading control is started, the stage specifying unit 1218 transitions the work stage to the down swing stage Ph1.

In a case where the work stage is the down swing stage Ph1, the stage specifying unit 1218 maintains the down swing stage Ph1 when the distance between the position of the tip portion of the arm 112 and the excavation position P05 is equal to or greater than a predetermined threshold value. On the other hand, in a case where the work stage is the down swing stage Ph1, the stage specifying unit 1218 transitions the work stage to the excavation stage Ph2 when the distance between the position of the tip portion of the arm 112 and the excavation position P05 is less than a predetermined threshold value.

In a case where the work stage is the excavation stage Ph2, the stage specifying unit 1218 maintains the excavation stage Ph2 in a case where the difference between the inclination angle of the bucket 113 and an excavation completion angle is equal to or greater than a predetermined threshold value. The excavation completion angle is the angle of the bucket 113 with respect to the horizon plane at the time of excavation completion. On the other hand, in a case where the work stage is the excavation stage Ph2, the stage specifying unit 1218 transitions the work stage to the hoist swing stage Ph3 in a case where the difference between the inclination angle of the bucket 113 and the excavation completion angle is less than the predetermined threshold value.

In a case where the work stage is the hoist swing stage Ph3, the stage specifying unit 1218 maintains the hoist swing stage Ph3 in a case where the distance between the position of the tip portion of the arm 112 and the dumping start position P07 is equal to or greater than a predetermined threshold value. On the other hand, in a case where the work stage is the hoist swing stage Ph3, the stage specifying unit 1218 transitions the work stage to the dump stage Ph4 in a case where the distance between the position of the tip portion of the arm 112 and the dumping start position P07 is less than the predetermined threshold value.

In a case where the work stage is the dump stage Ph4, the stage specifying unit 1218 maintains the dump stage Ph4 in a case where the difference between the inclination angle of the bucket 113 and the dump completion angle is equal to or greater than the predetermined threshold value. The dump completion angle is the angle of the bucket 113 with respect to the horizon plane at the time of dumping end. On the other hand, in a case where the work stage is the dump stage Ph4, the stage specifying unit 1218 transitions the work stage to the down swing stage Ph1 in a case where the difference between the inclination angle of the bucket 113 and the dump completion angle is less than the predetermined threshold value and the number of times of loading is less than a predetermined number of times. On the other hand, in a case where the work stage is the dump stage Ph4, the stage specifying unit 1218 determines that the automatic excavation and loading work is ended in a case where the difference between the inclination angle of the bucket 113 and the dump completion angle is less than the predetermined threshold value, and the number of times of loading is equal to the predetermined number of times.

<<Configuration of Limiting Unit 1221>>

Figure 9:
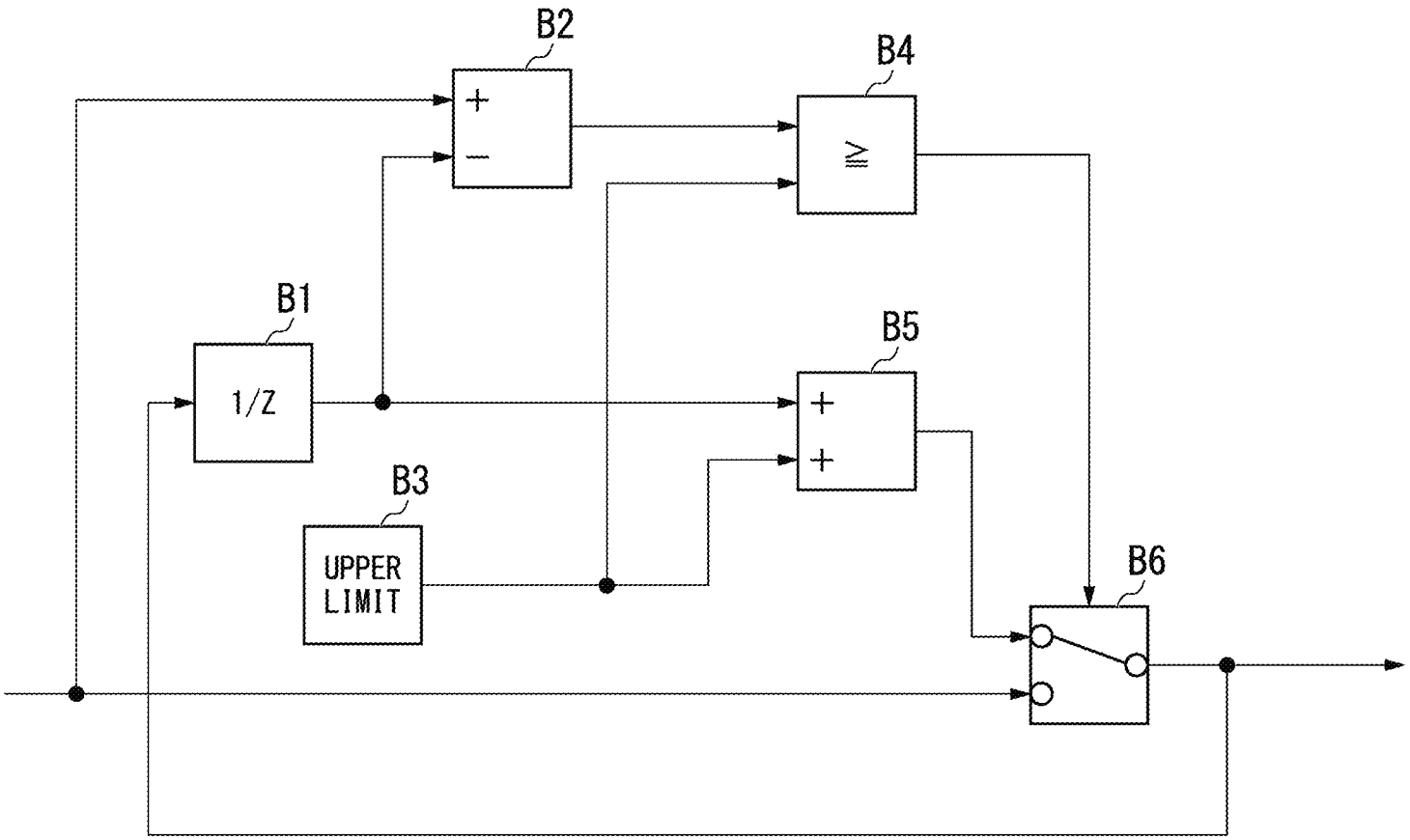
FIG. 9 is a block line diagram showing an operation of a limiting unit 1221 according to the first embodiment.

FIG. 9 is a block line diagram showing an operation of a limiting unit 1221 according to the first embodiment.

The limiting unit 1221 includes a delay block B1, a subtraction block B2, an upper limit value output block B3, a comparison block B4, an addition block B5, and a switch block B6.

The delay block B1 delays a signal output by the switch block B6 by a unit time and outputs the signal. That is, the delay block B1 outputs the previous control amount of the arm 112.

The subtraction block B2 outputs a value obtained by subtracting the previous control amount, which is the output value of the delay block B1, from the newly input control amount of the arm 112. That is, the subtraction block B2 outputs the change amount of the control amount of the arm 112.

The upper limit value output block B3 always outputs the change amount upper limit value of the control amount in the hoist swing stage of the arm 112.

The comparison block B4 outputs a comparison result between the change amount of the control amount of the arm 112 which is the output value of the subtraction block B2 and the change amount upper limit value which is the output value of the upper limit value output block B3. The comparison block B4 outputs 1 when the change amount of the control amount is equal to or greater than the change amount upper limit value, and outputs 0 when the change amount of the control amount is less than the change amount upper limit value. That is, the comparison block B4 determines whether or not the change amount of the control amount of the arm 112 is equal to or greater than the change amount upper limit value.

The addition block B5 outputs a value obtained by adding the previous control amount which is the output value of the delay block B1 and the change amount upper limit value which is the output value of the upper limit value output block B3. That is, the addition block B5 outputs a control amount that is increased by the change amount upper limit value from the previous control amount.

The switch block B6 outputs either the newly input control amount of the arm 112 or the output value of the addition block B5, based on the output of the comparison block B4. Specifically, the switch block B6 outputs the output value of the addition block B5 in a case where the output of the comparison block B4 is 1. In a case where the output of the comparison block B4 is 0, the switch block B6 outputs the newly input control amount of the arm 112. That is, the switch block B6 outputs a control amount that is increased by the change amount upper limit value from the previous control amount in a case where the change amount of the control amount is equal to or greater than the change amount upper limit value. On the other hand, the switch block B6 outputs the control amount in a case where the change amount of the control amount is less than the change amount upper limit value.

By providing such a configuration, the limiting unit 1221 limits the control amount of the arm 112 calculated by the control amount calculation unit 1220 so that the change amount is within a predetermined change amount upper limit value.

<<Automatic Excavation and Loading Control>>

Figure 10:
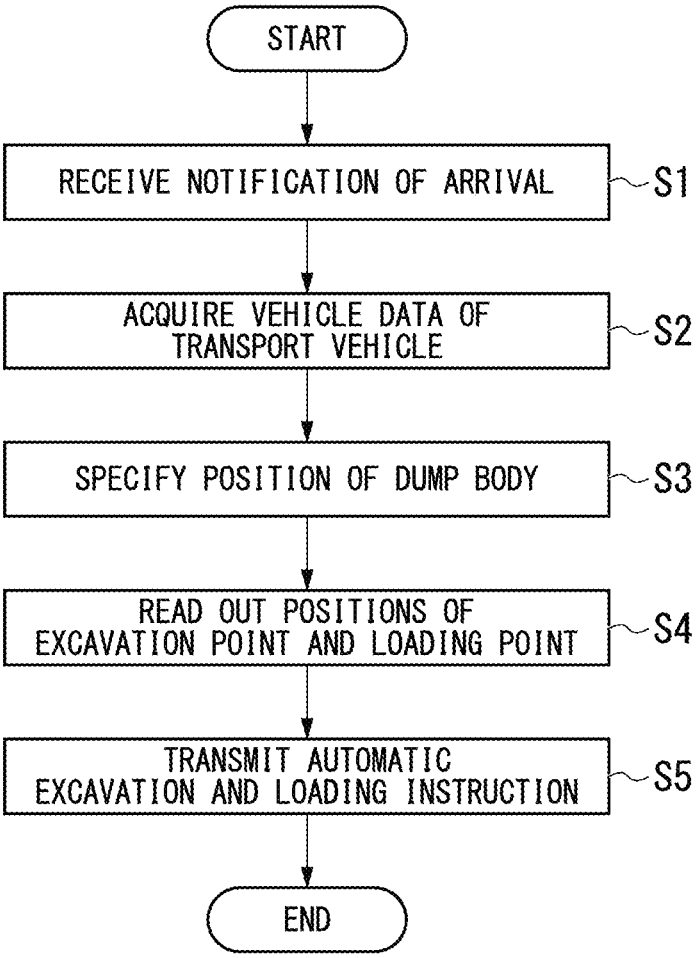
FIG. 10 is a flowchart showing a method of outputting an automatic excavation and loading instruction by the controlling device according to the first embodiment.

FIG. 10 is a flowchart showing a method of outputting the automatic excavation and loading instruction by the controlling device 300 according to the first embodiment.

When the notification receiving unit 314 of the controlling device 300 receives a notification of the arrival at the loading point P3 from the transport vehicle 200 (step S1), the loading container specifying unit 1214 acquires the vehicle data from the transport vehicle 200 (step S2). The loading container specifying unit 1214 specifies the position of the dump body 201 in the field coordinate system, based on the acquired vehicle data (step S3). The loading container specifying unit 1214 transmits the specified position of the dump body 201 to the work machine 100.

The automatic excavation and loading instruction unit 316 reads out the positions of the excavation point P22 and the loading point P3 from the control position storage unit 351 (step S4). The automatic excavation and loading instruction unit 316 transmits the automatic excavation and loading instruction including the read positions of the excavation point P22 and the loading point P3 to the work machine 100 (step S5).

Figure 11:
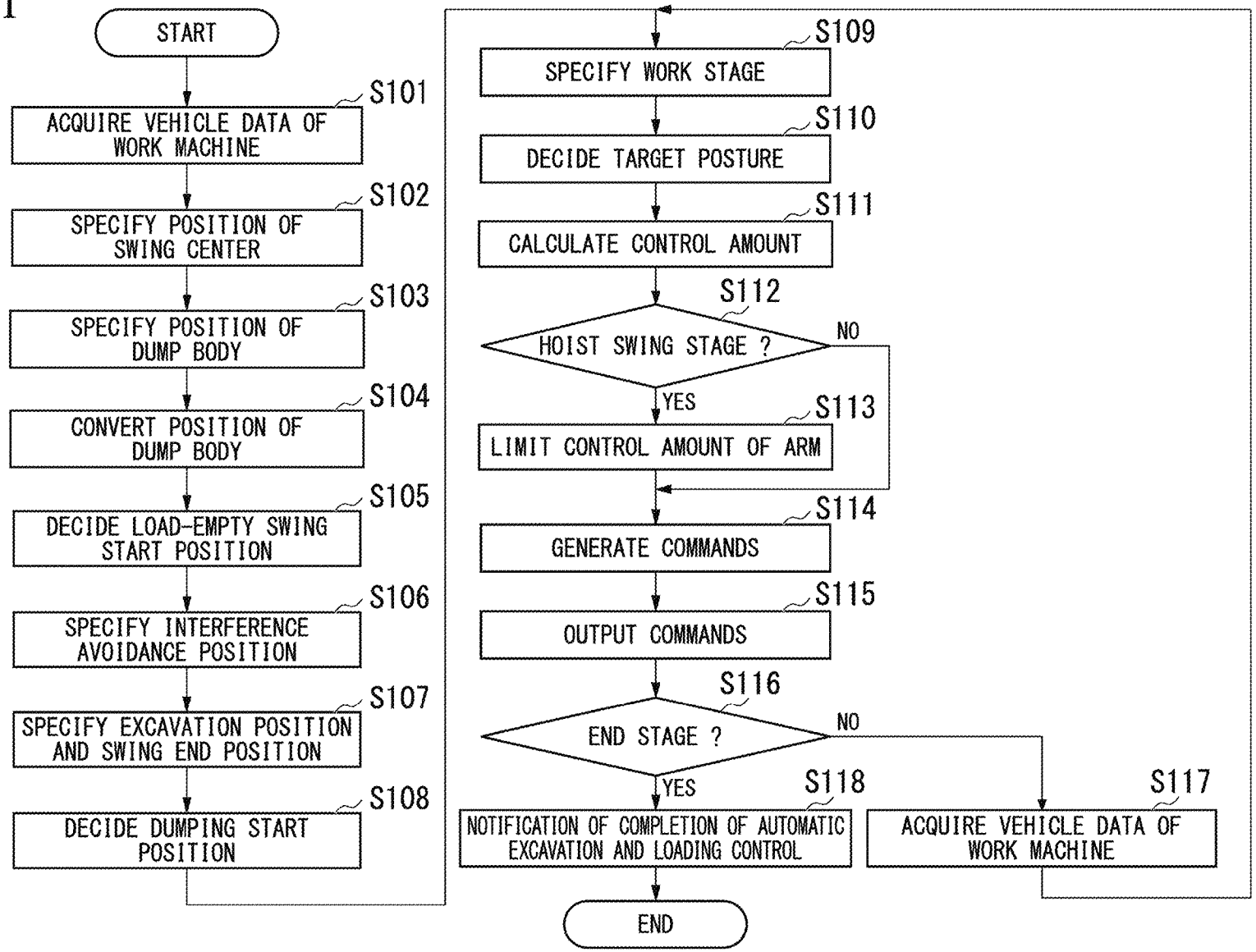
FIG. 11 is a flowchart showing an operation when the work machine according to the first embodiment receives an input of the automatic excavation and loading instruction.

FIG. 11 is a flowchart showing an operation when the work machine 100 according to the first embodiment receives an input of the automatic excavation and loading instruction.

When the instruction receiving unit 1213 of the control device 125 receives the input of the automatic excavation and loading instruction from the controlling device 300, the processing shown in FIG. 10 is executed.

The vehicle data acquisition unit 1211 acquires the position and azimuth direction of the swing body 120, the inclination angles of the boom 111, the arm 112, and the bucket 113, and the posture of the swing body 120 (step S101). The vehicle data acquisition unit 1211 specifies the position of the swing center of the swing body 120 based on the acquired position and azimuth direction of the swing body 120 (step S102).

The loading container specifying unit 1214 acquires the position of the dump body 201 in the field coordinate system from the controlling device 300 (step S103). The loading container specifying unit 1214 converts the position of the dump body 201 from the field coordinate system to the machine coordinate system, based on the position, azimuth direction, and posture of the swing body 120 acquired in step S101 (step S104).

The posture specifying unit 1212 decides the position of the pin of the bucket 113 at the time of inputting the automatic excavation and loading instruction at the load-empty swing start position P01 based on the vehicle information acquired in step S101 (step S105). The avoidance position specifying unit 1215 specifies the interference avoidance position P02 based on the load-empty swing start position P01 decided in step S105 and the position of the dump body 201 specified in step S104 (step S106). The excavation position specifying unit 1216 specifies the excavation position P05 and the swing end position P04 based on the position of the excavation point P22 included in the automatic excavation and loading instruction (step S107). The start position decision unit 1217 decides the dumping start position based on the position of the dump body 201 specified in step S104, the moving distance of the lowest point of the bucket 113 by the automatic dumping control obtained in advance, and the number of times of loading into the transport vehicle 200 (step S108).

Next, the stage specifying unit 1218 specifies the work stage based on a determination method shown in FIG. 8 (step S109). The work stage immediately after the start of the automatic excavation and loading processing is the down swing stage.

The target decision unit 1219 decides the target posture of the work machine 100 according to the work stage specified in step S109 (step S110). The control amount calculation unit 1220 calculates the control amount of the boom 111, the arm 112, the bucket 113, and the swing body 120 based on the target posture decided in step S110 and the vehicle data acquired by the vehicle data acquisition unit 1211 (step S111).

The limiting unit 1221 determines whether or not the work stage specified in step S109 is the hoist swing stage (step S112). In a case where the control stage is the hoist swing stage, the limiting unit 1221 limits the control amount of the arm 112 calculated in step S111 so that the change amount is within the change amount upper limit value (step S113). The command generation unit 1222 generates a boom command, an arm command, a bucket command, and a swing command based on the calculated control amount (step S114). The command output unit 1223 outputs the swing command, the boom command, the arm command, and the bucket command generated in step S114 (step S115).

Next, the command output unit 1223 determines whether or not the work stage specified in step S109 is the end stage (step S116). In a case where the work stage is not the end stage (step S116: NO), the vehicle data acquisition unit 1211 newly acquires vehicle data (step S117) and returns the process to step S109.

On the other hand, in a case where the work stage is the end stage (step S116: YES), the command output unit 1223 transmits a notification of the completion of the automatic excavation and loading control to the controlling device 300 (step S118), and ends the process.

As described above, the work system 1 according to the first embodiment limits the control amount of the arm 112 so that the change amount is within the change amount upper limit value in a case where the work stage is the hoist swing stage. As a result, the work machine 100 can suppress dropping of the earth between excavation and dumping.

Here, the reason why the dropping of the earth can be suppressed by limiting the control amount of the arm 112 in the hoist swing stage will be described.

The work machine 100, such as a backhoe excavator, performs excavation by moving the teeth of the bucket 113 to the rear side, that is, by moving the work equipment 110 in the pulling direction. Therefore, at the end of excavation by the work machine 100, the bucket 113 is generally located in the vicinity of the swing body 120. At this time, the arm 112 may be inclined toward the swing body 120 from the vertical direction. The position of the tip portion of the arm 112 goes down as the angle approaches the vertical. Therefore, when the arm 112 is driven in a pushing direction while the arm 112 is inclined toward the swing body 120, the bucket 113 temporarily lowers and then rises. Therefore, in a case where the control amount is not limited, when the hoist swing is started, the bucket 113 may move at high speed due to the weight of the bucket 113 and the earth, and the earth may spill.

On the other hand, in the work system 1 according to the first embodiment, the moving speed of the bucket 113 can be suppressed by limiting the control amount of the arm 112 in the hoist swing stage. As a result, the work system 1 can suppress dropping of the earth even at the timing when the hoist swing is started.

Although an embodiment has been described in detail above with reference to the drawings, the specific configuration is not limited to the configuration described above, and various design changes or the like can be made. That is, in another embodiment, the order of the processing described above may be changed appropriately. Further, some processing may be executed in parallel.

The control device 125 and the controlling device 300 according to the embodiment described above may be configured by a single computer, or the configuration of the control device 125 or the controlling device 300 may be divided into a plurality of computers, so that the plurality of computers cooperate with each other to function as the control device 125 or the controlling device 300. At this time, a portion of the computers constituting the controlling device 300 may be mounted inside the work machine 100, and other computers may be provided outside the work machine 100. Further, a portion of the computers constituting the control device 125 may be mounted inside the work machine 100, and other computers may be provided outside the work machine 100.

Further, the control device 125 according to the embodiment described above always limits the control amount of the arm 112 within the change amount upper limit value in the hoist swing stage, but is not limited to this. For example, the control device 125 according to another embodiment may limit the control amount within the change amount upper limit value only when the angle of the arm 112 is inclined toward the swing body 120 from the vertical direction.

It is possible to suppress dropping of the earth between excavation and dumping by a work machine.

The invention claimed is:

1. A work system for a work machine including a boom, an arm, and a bucket, the work system comprising:

a stage specifying unit configured to specify a work stage of the work machine;

a target decision unit configured to decide a target boom posture of the boom and target arm posture the arm based on the specified work stage;

a control amount calculation unit configured to calculate a boom control amount of the boom based on the target boom posture and an arm control amount of the arm based on the target arm posture; and a limiting unit configured to limit the arm control amount of the arm such that a change amount of the arm control amount with respect to a previous arm control amount is equal to or smaller than a predetermined change amount upper limit value when the specified work stage is a hoist swing stage.

2. The work system according to claim 1, further comprising a posture acquisition unit configured to acquire a measured boom posture and a measured arm posture indicating measured values of postures of the boom and the arm, respectively, the control amount calculation unit being configured to calculate the boom control amount based on the target boom posture and the measured boom posture, and calculate the arm control amount based on the target arm posture and the measured arm posture.

3. The work system according to claim 2, wherein the boom control amount increases monotonically with respect to a difference between the measured boom posture and the target boom posture, and the arm control amount increases monotonically with respect to a difference between the measured arm posture and the target arm posture.

4. The work system according to claim 1, wherein the stage specifying unit is configured to specify the work stage as one work stage among a plurality of work stages, the plurality of work stages including at least the hoist swing stage, and the host swing stage is a stage in which the work machine performs an operation of moving a swing body of the work machine while raising the bucket such that the bucket is positioned above a dump body.

5. The work system according to claim 4, wherein the plurality of work stages includes a down swing stage, an excavation stage, the hoist swing stage, and a dump stage.

6. The work system according to claim 5, wherein the hoist swing stage is executed between the excavation stage and the dump stage.

7. A control method of a work machine including a boom, an arm, and a bucket, the control method comprising:

specifying a work stage of the work machine;

deciding a target boom posture of the boom and a target arm posture of the arm based on the specified work stage;

calculating a boom control amount of the boom based on the target boom posture and an arm control amount of the arm based on the target arm posture; and limiting the arm control amount such that a change amount of the arm control amount with respect to a previous arm control amount is equal to or smaller than a predetermined change amount upper limit value when the specified work stage is a hoist swing stage.

* * * * *